United States Patent [19]

Harris

[11] Patent Number: 4,890,704

[45] Date of Patent: Jan. 2, 1990

[54] FOLDING IRONING BOARD

[76] Inventor: Robert L. Harris, 16500 Patton St., Detroit, Mich. 48219

[21] Appl. No.: 243,624

[22] Filed: Sep. 13, 1988

[51] Int. Cl.[4] ..... A47B 85/00; A45G 9/00

[52] U.S. Cl. ..... 190/11; 190/1; 38/112; 38/139

[58] Field of Search ..... 190/1, 11; 38/112, 139

[56] References Cited

U.S. PATENT DOCUMENTS

| | | | |
|---|---|---|---|
| 1,207,469 | 12/1916 | Banas | 38/112 X |
| 2,326,062 | 8/1943 | Parker | 38/139 |
| 2,432,932 | 12/1947 | Peters | 38/139 |
| 2,499,078 | 2/1950 | Shaw | 38/117 |
| 2,516,235 | 7/1950 | Morgan | 38/114 |
| 2,594,123 | 4/1952 | Cater | 38/139 X |
| 2,603,011 | 7/1952 | Plumb | 38/139 X |
| 2,630,639 | 3/1953 | Kmonk | 38/139 |
| 2,675,635 | 4/1954 | Toth | 38/117 |
| 2,721,407 | 10/1955 | Sutherland | 38/117 |
| 2,729,905 | 1/1956 | Crozier | 190/11 X |
| 3,049,825 | 8/1962 | Boyd | 38/112 |
| 3,326,337 | 6/1967 | Bell | 190/11 |
| 3,441,112 | 4/1969 | Maben | 190/11 |
| 3,483,954 | 12/1969 | Michalski | 190/42 |
| 3,512,620 | 5/1970 | Bell et al. | 190/11 |
| 3,516,523 | 6/1970 | Pemberton, Jr. | 190/11 |
| 3,732,639 | 5/1973 | Elder | 38/139 |
| 4,412,604 | 11/1983 | Bell et al. | 190/1 |
| 4,602,446 | 7/1986 | Guion | 38/139 |

*Primary Examiner*—William Price

*Attorney, Agent, or Firm*—Robert G. Mentag

[57] ABSTRACT

A portable, folding ironing board including a case section and a hingedly attached nose section which nests in a side of the case section when the folding ironing board is transported, and the case section has an interior storage compartment for ironing accessories, such as an iron and ironing board cover.

3 Claims, 1 Drawing Sheet

FOLDING IRONING BOARD

BACKGROUND OF THE INVENTION

1. Technical Field

The field of art to which this invention pertains may be generally located in the class of devices relating to ironing devices. Class 38, Ironing Board, Sub-Class 103, United States Patent Office Classification, appears to be the applicable general area of art to which the subject matter similar to this invention has been classified in the past.

2. Background Information

It is known in the ironing board art to provide folding ironing boards. Some of the prior art folding ironing boards are adapted to be inserted in carrying cases of various types to make them portable. Other prior art folding ironing boards are constructed for incorporation with a conventional luggage case. The aforementioned prior art folding ironing boards have many disadvantages in that they are complex in structure, heavy in weight, and cumbersome for transporting the same.

Examples of prior art folding ironing boards which are portable, and which include supporting legs are disclosed in the following U.S. Pat. Nos.:

Parker 2,326,062 issued Aug. 3, 1943
Shaw 2,499,078 issued Feb. 28, 1950
Kmonk 2,630,639 issued Mar. 10, 1953
Toth 2,675,635 issued Apr. 20, 1954
Boyd 3,049,825 issued Aug. 21, 1962
Bell 3,326,337 issued June 20, 1967
Maben 3,441,112 issued Apr. 29, 1969
Michalski 3,483,954 issued Dec. 16, 1969
Bell 3,512,620 issued May 19, 1970
Elder 3,732,639 issued May 15, 1973
Bell et al 4,412,604 issued Nov. 1, 1983

SUMMARY OF THE INVENTION

It is an object of this invention to provide an improved folding ironing board of simple and economical construction and which is light in weight and portable.

It is another object of this invention to provide a portable folding ironing board which does not require any ground engaging support legs, and which can be quickly and easily used by laying the same on a flat surface, such as the surface of a table, a desk or the like.

In accordance with the invention, the foregoing objects are accomplished by constructing a folding ironing board which has an overall appearance of a luggage case, when it is folded into an inoperative or closed position. The folding ironing board includes a case section, and a nose section which is hingedly mounted to one end of the case section. The case section and nose section are adapted to be disposed in an open position so as to form a continuous ironing board surface, with one of the side panels of the case section disposed on a flat supporting surface, such as a surface of a supporting table or desk. In the inoperative or closed position the nose section folds into a nesting position in the case section so as to produce a luggage case appearance for the folded ironing board. The case section is provided with a handle for carrying the folded ironing board, and it includes an interior storage compartment which is accessible when the ironing board is in the open position, for storing ironing accessories, such as an iron and an ironing board cover.

DESCRIPTION OF THE PREFERRED EMBODIMENT

Figure 1:
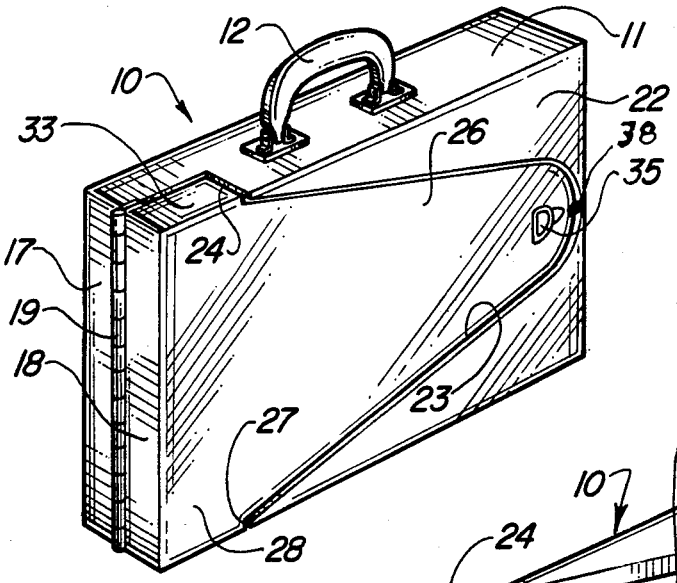
FIG. 1 is an elevation perspective view of a portable, folding ironing board made in accordance with the principles of the present invention.
Figure 2:
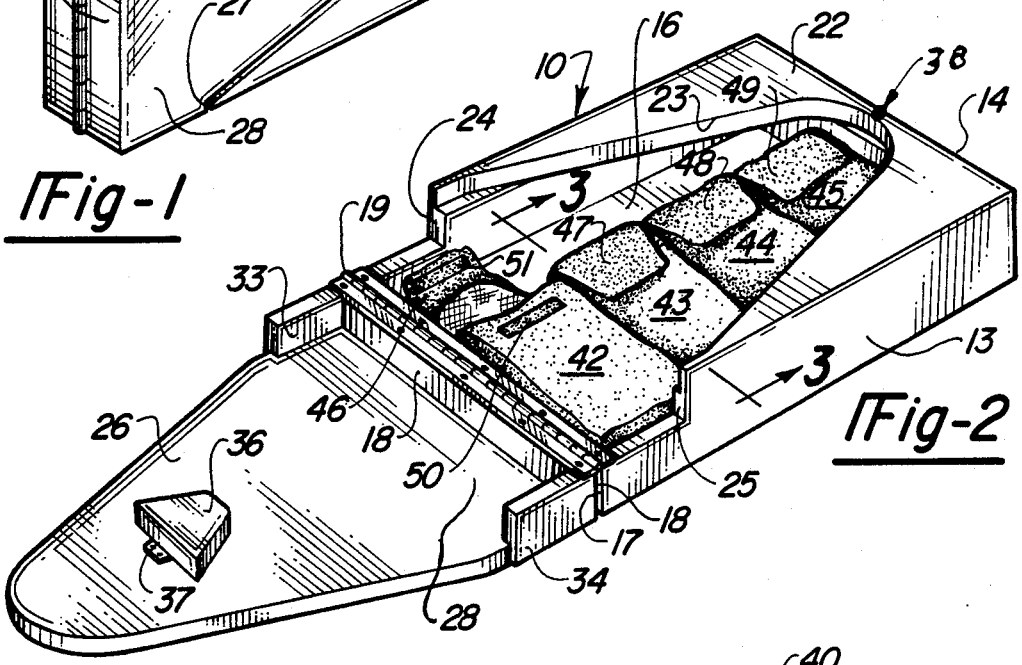
FIG. 2 is an elevation perspective view of the bottom of the portable, folding ironing board of the present invention, and showing the folding ironing board in an open position.
Figure 4:
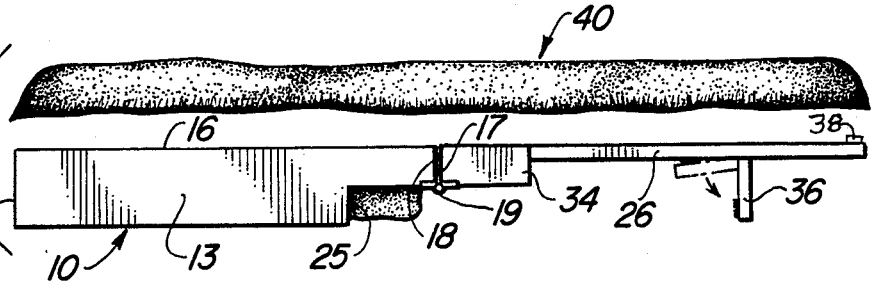
FIG. 4 is a side elevation view of the folding ironing board of the present invention, showing the same in an upright operative position, and with an ironing board cover spaced therefrom, before lowering the same onto the ironing board for operative use of the folding ironing board.

Referring now to the drawing, and in particular to FIG. 1, the numeral 10 generally designates a portable, folding ironing board made in accordance with the principles of the present invention, and showing the ironing board in a folded condition which presents a luggage case appearance. The portable, folding ironing board 10 includes a carrying case section which includes a top panel 11 to which is fixedly secured a handle 12. The case section is substantially rectangular in overall configuration. As shown in FIG. 2, the folding ironing board case section includes a bottom panel 13 and a front side panel 14 (FIG. 4). The folding ironing board 10 further includes an outer side panel 16 and a rear partial panel 17 (FIG. 1).

The portable folding ironing board 10 further includes a nose section which includes a rear partial panel 18 that is disposed in alignment with the case section rear partial panel 17 and which is joined thereto by a suitable hinge 19. The combined partial panels 17 and 18 form the rear overall panel for the overall luggage case appearance of the folding ironing board when it is in the closed or collapsed carrying position shown in FIG. 1.

The folding ironing board case section includes an inner side panel 22 which has a nose shaped opening 23 formed therein for the nesting reception of the nose section panel 26. The nose shaped opening 23 in the inner side panel 22 is rounded at the front end thereof, adjacent the front panel 14 of the case section and the sides of the opening 23 extend toward the rear of the case section and diverge from each other and terminate at a point indicated by the numeral 27, as shown in FIG. 1. The front end of the nose section panel 26 is shaped to fit in the aforementioned opening in the case section inner side panel, and the rear end 28 thereof is enlarged to form the complete rear end of the inner side of the case section to provide the overall luggage case appearance of the folded ironing board. The nose shaped opening 23 and the nose section panel 26 are each substantially elliptical in shape.

As shown in FIG. 2, the case section top and bottom panels 11 and 13 have a portion cut out at their rear ends as indicated by the numerals 24 and 25. The aforementioned panel cut out portions commence at the rear end of the opening 23 in the inner side panel 22. The nose section includes a partial upper panel portion 33 and a partial lower panel portion 34. The nose section partial panels 33 and 34 are adapted to be seated in the openings 24 and 25 in the case section panels 11 and 13, when the nose section is folded into the closed position as shown in FIG. 1.

Figure 5:
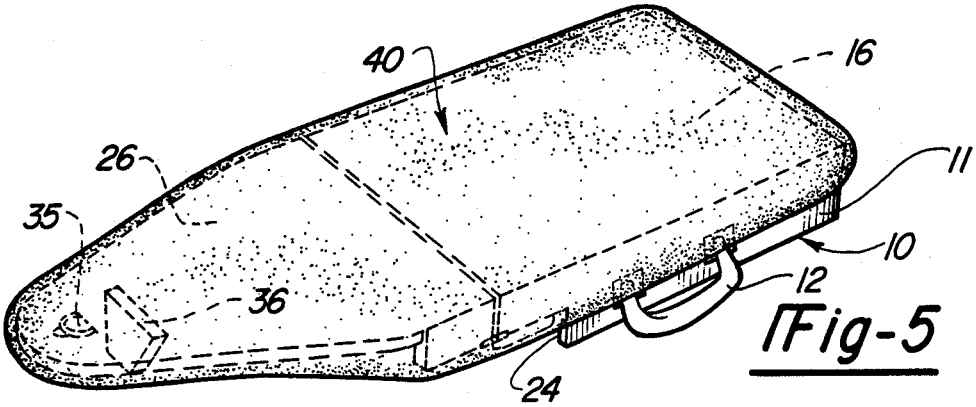
FIG. 5 is a perspective view of the folding ironing board of the present invention, and showing the same in an operative position with an ironing board cover mounted on the ironing board surface.

As shown in FIG. 1, the nose section is provided with a suitable finger grip opener member 35 for grasping the same and moving the nose section to the open position shown in FIGS. 2, 4 and 5. As shown in FIGS. 2 and 4, when the nose section is in the open position a support leg 36, which is hingedly secured to the inner side of the nose section, is adapted to be swung down from a nested position shown in FIG. 2 to an operative position shown in FIG. 4 for supporting the nose section on a flat surface, such as a table or desk when the folding ironing board 10 is to be used. As illustrated in FIG. 1 a suitable latch means 38 is employed to hold the nose section in a closed position in the case section for carrying purposes. One portion of the latch means is mounted on the nose section and the other mating portion is mounted on the inner panel 22 of the case section.

The case section panels are fixedly secured together by any suitable means, as by gluing them together with a suitable adhesive. The nose section panels are also fixedly secured together in a similar manner. The aforementioned case and nose section panels made by made from any suitable material, as for example: wood, plastic impregnated with fiber glass or the like, and other suitable man-made lightweight materials.

Figure 3:
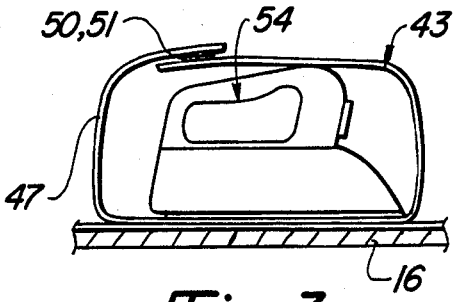
FIG. 3 is a fragmentary, elevation section view of the folding ironing board structure illustrated in FIG. 2, taken along the lines 3—3, and looking in the direction of the arrows.

As shown in FIG. 2, the case section contains an inner storage compartment in which is fixedly mounted by any suitable means, a plurality of storage pockets, generally indicated by the numerals 42, 43, 44 and 45. The pockets 42–45 may be made from any suitable material, as for example, a suitable plastic material. Each of the storage pockets 42–45 are provided with closure flaps 46 through 49, respectively. The flaps 46–49 are adapted to be releasably secured in a closed position, as shown in FIG. 3, by a pair of suitable "VELCRO" strips 50 and 51. As shown in FIG. 3 an iron 54 may be stored in one of the storage pockets 42–45. The ironing board cover 40 may also be folded and stored in the storage compartment inside of the case section.

When the portable folding ironing board 10 of the present invention is not in use, the nose section is folded into the closed position, as shown in FIG. 1, whereby the folding ironing board is ready for being transported by a user. The folded ironing board 10 is made ready for use, by swinging the nose section from the closed position shown in FIG. 1 to the open position shown in FIGS. 2, 4 and 5, and positioning the ironing on a flat surface such as a table, a desk, or the like. The outer surface of the case section panel 16 and the outer surface of the nose section 26 then forms a continuous ironing board surface which may be covered by a suitable ironing board cover 40.

What is claimed is:

1. A portable, folding ironing board comprising:

(a) a generally rectangular case section, having an interior compartment and which includes an outer side panel, an inner side panel, a top panel, a bottom panel, a front side panel, and a first partial rear side panel, said case section panels being fixedly secured together to form said interior compartment;

(b) a nose section having a panel with a nose shaped front end and a transverse rear end, and a second partial rear side panel being fixedly secured to the rear end of the nose section panel, said second partial rear side panel being hingedly attached to the first partial rear side panel and said nose section panel, being manually movable between a closed, inoperative position and an open, operative position relative to the case section;

(c) the case section inner side panel being provided with a nose shaped opening formed therein and which extends from the rear end of the case section to a point adjacent the front end of the case section and which nose shaped opening permits access to the interior compartment when the nose section panel is in the operative position;

(d) the nose shaped panel of the nose section nests in the nose shaped opening in the case section inner side panel when the nose section panel is in the closed position;

(e) latch means for releasably retaining the nose shaped panel of the nose section in the nose shaped opening in the case section when the nose section panel is in the closed position;

(f) said case section being provided with handle means for transporting the folding ironing board, and said folding ironing board being adapted to be placed on a supporting surface, as a table, in an upright position, with the nose section panel in an open position to provide an ironing board operative surface formed by the outer surfaces of the nose section panel and the case section front side panel; and, (g) support leg means for retaining the nose section panel level with the case section front side panel during use of the ironing board.

2. A portable, folding ironing board as defined in claim 1, wherein:

(a) the nose shaped opening in the case section inner side panel is elliptical in shape, and the nose shaped panel of the nose section panel has an elliptical shaped front end.

3. A portable, folding ironing board as defined in claim 1, wherein:

(a) the case section has mounted in the interior compartment storage means for storing ironing accessories, such as iron and an ironing board cover.

* * * * *